US011879181B2

(12) United States Patent
Jung et al.

(10) Patent No.: US 11,879,181 B2
(45) Date of Patent: Jan. 23, 2024

(54) ELECTROPLATING SOLUTION OF TIN OR TIN ALLOY WITH IMPROVED THICKNESS VARIATION OF WAFER BUMPS

(71) Applicant: HOJIN PLATECH CO., LTD., Ansan-si (KR)

(72) Inventors: Woon Suk Jung, Ansan-si (KR); Jong Uk Kim, Gunpo-si (KR); Jin Gyu Lee, Siheung-si (KR)

(73) Assignee: HOJIN PLATECH CO., LTD., Ansan-si (KR)

( * ) Notice: Subject to any disclaimer, the term of this patent is extended or adjusted under 35 U.S.C. 154(b) by 0 days.

(21) Appl. No.: 17/935,410

(22) Filed: Sep. 26, 2022

(65) Prior Publication Data

US 2023/0151504 A1 May 18, 2023

(30) Foreign Application Priority Data

Nov. 15, 2021 (KR) ..... 10-2021-0156696

(51) Int. Cl.
*C25D 3/32* (2006.01)
*C25D 3/60* (2006.01)

(52) U.S. Cl.
CPC ..... *C25D 3/32* (2013.01); *C25D 3/60* (2013.01)

(58) Field of Classification Search
None
See application file for complete search history.

(56) References Cited

U.S. PATENT DOCUMENTS

2013/0206602 A1* 8/2013 Lee ..... C25D 7/00 205/253

FOREIGN PATENT DOCUMENTS

JP 2002-115091 A 4/2002
KR 10-2013-0092515 A 8/2013

* cited by examiner

*Primary Examiner* — Wojciech Haske
(74) *Attorney, Agent, or Firm* — SALIWANCHIK, LLOYD & EISENSCHENK

(57) ABSTRACT

Provided is an electroplating solution of tin or a tin alloy in which the thickness variation of wafer bumps is maintained at a low level even in various changes of plating conditions and thus the mass productivity is improved. The electroplating solution of tin or a tin alloy may include tin ions as metal ions, a conductive salt, a carboxylic acid as a structure refiner, and a combination of a flavone compound and a quaternary ammonium compound as a thickness variation improving agent.

5 Claims, 2 Drawing Sheets

ELECTROPLATING SOLUTION OF TIN OR TIN ALLOY WITH IMPROVED THICKNESS VARIATION OF WAFER BUMPS

CROSS-REFERENCE TO RELATED APPLICATION

This application claims priority to Korean Patent Application No. 10-2021-0156696 filed on Nov. 15, 2021 and all the benefits accruing therefrom under 35 U.S.C. § 119, the contents of which are incorporated by reference in their entirety.

BACKGROUND

The present disclosure relates to an electroplating solution of tin or a tin alloy, and more specifically, to an electroplating solution of tin or a tin alloy with improved thickness variation of wafer bumps even in a high current density.

Bumps are protruding metal terminals for connecting integrated circuits to external circuit boards or intermediate substrate circuits, and are formed of, for example, solder (alloys of lead and tin) or lead-free solder (e.g., tin, tin alloys). As a production method of bumps, for example, a vapor deposition method, an electroplating method, a paste printing method, and a micro-ball method have been known. As the number of bumps for connection to external circuits has recently been increased with integration and densification of semiconductor device circuits, narrowing of bump pitch or downsizing of bump size has strongly been required. Among the production methods, since a paste printing method or a micro-ball method is difficult to be applied to a small-sized bump, an electroplating method capable of producing narrow pitch or small-diameter bumps have received attention.

As an electroplating method for bumps, electroplating using tin or a tin alloy is mainly used, and a method of producing bumps by putting up a pillar using copper plating, and plating tin or a tin alloy on the pillar for narrowing and densification of pitch has recently been used. What is important in bump electroplating is the uniform size and thickness variation of bumps, reflow performance, a plating rate, etc. In particular, the plating rate is a very important variable in the actual production process because it determines the yield of the entire production process. If the current density is raised to increase the plating rate, there is a limitation in that burnt deposits or non-uniform particle sizes occur and thus the thickness variation is increased. In order to overcome this, a structure refiner such as ketones or aldehydes has been typically used in a tin or tin-silver alloy plating solution, and small uniform particles could be obtained in spite of high plating speed (or current density), but there occurred a limitation in that the bump shape is not round but dented. Furthermore, ketones or aldehydes tend to be consumed at a relatively fast rate compared to other reactants at a high current density. In order to form a uniform plating film, the concentration of each reactant in the plating solution must be kept constant, but when the consumption rate is high as above, there is a difficulty in that the components of the plating solution have to be analyzed and managed frequently.

In addition, in order to mass-produce the bump plating using tin or a tin alloy, it is also necessary to improve the thickness variation of bumps depending on the change of the plating conditions.

In addition, conventionally, in the electroplating of a tin-silver alloy, a cyanide compound has been mainly used as a silver complexing agent for the stability of silver ions. However, the cyanide compound is a harmful substance to the human body, and has a limitation that the working environment is deteriorated. The use of phenylurea as an alternative to this cyanide compound has been proposed. When phenylurea is used as a silver complexing agent, the effect of uniformly maintaining silver ions in the plating solution may be obtained, but it is insufficient to secure mass productivity. In general, in the process of mass-producing bump plating, plating conditions such as wafer size, current density, temperature, and flow rate are changed depending on a produced product or a need. When these plating conditions are changed, the silver content in the plating film tends to decrease or increase. Therefore, in order to secure mass productivity, it is important to keep the variation in the silver content in the plating film low even if the plating conditions are changed. In other words, the silver content must be maintained within a certain range over the entire region of the plating film. However, in the electroplating of the tin-silver alloy, when only phenylurea is used as a silver complexing agent, the variation in the silver content in the plating film is large due to changes in plating conditions such as wafer size, current density, temperature, and flow rate, and thus it was found that the using of only phenylurea did not reach the level of mass production.

In order to solve various limitations occurring in the mass-production of the electroplating for bumps as described above, the inventors of the present disclosure have studied and made efforts for a long period of time on the electroplating solution of tin or a tin alloy with a new combination, and thus have completed the present disclosure.

SUMMARY

The present disclosure provides an electroplating solution of tin or a tin alloy, from which a uniform plating film and a stable bump shape may be obtained even at a high current density in wafer bump plating, and the thickness variation of bumps may be improved, and furthermore, in the case of a tin-silver alloy plating solution, the plating solution may be easily managed by stably dissolving silver ions in the plating solution and maintaining, constant, the concentrations of all the reactants in the plating solution, and the variation in the silver content within the plating film is maintained low even in various changes of plating conditions and thus the mass productivity is improved.

The object of the present disclosure is not limited to the aforesaid, but other objects not described herein will be clearly understood by those skilled in the art from descriptions below.

In accordance with an embodiment of the present invention, an electroplating solution of tin or a tin alloy, which is an electroplating solution of tin or a tin alloy for wafer bumps, includes tin ions as metal ions, a conductive salt, a carboxylic acid as a structure refiner, and a combination of a flavone compound and a quaternary ammonium compound as a thickness variation improving agent.

The weight ratio of the flavone compound and the quaternary ammonium compound constituting the thickness variation improving agent may be approximately 1:5 to 1:10.

The electroplating solution may include approximately 0.01-0.3 g/L of pentahydroxyflavone and approximately 0.1-5 g/L of benzalkonium chloride as the thickness variation improving agent.

When the electroplated bump with the electroplating solution is subjected to reflow treatment, the average within-die (WID) of the bumps may be approximately 2.9%-3.5%.

The electroplating solution may further include silver ions as metal ions, and the electroplating solution may further include a combination of phenylurea and a mercaptotetrazole compound as a silver complexing agent. In this case, the weight ratio of the phenylurea and the mercaptotetrazole compound may be approximately 2:1 to 10:1.

The mercaptotetrazole compound may be 1-(2-diethylaminoethyl)-5-mercapto-1,2,3,4-tetrazole.

The structure refiner may consist of only a carboxylic acid except for ketones and aldehydes.

The electroplating solution may include 40-120 g/L of tin ions as metal ions, 100-300 g/L of a methanesulfonic acid as a conductive salt, 0.1-5 g/L of a carboxylic acid as a structure refiner, 0.5-6 g/L of an amine-based nonionic surfactant, 0.1-2 g/L of hydroquinone as an antioxidant, and 0.01-0.3 g/L of pentahydroxyflavone and 0.1-5 g/L of benzalkonium chloride as a thickness variation improving agent.

The electroplating solution may include 40-120 g/L of tin ions and 0.1-1 g/L of silver ions as metal ions, 100-300 g/L of a methanesulfonic acid as a conductive salt, 5-30 g/L of phenylurea and 0.5-10 g/L of a mercaptotetrazole compound as a silver complexing agent, 0.1-5 g/L of a carboxylic acid as a structure refiner, 0.5-6 g/L of an amine-based nonionic surfactant, 0.1-2 g/L of hydroquinone as an antioxidant, and 0.01-0.3 g/L of pentahydroxyflavone and 0.1-5 g/L of benzalkonium chloride as a thickness variation improving agent.

Details of other embodiments are included in the detailed description and drawings.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
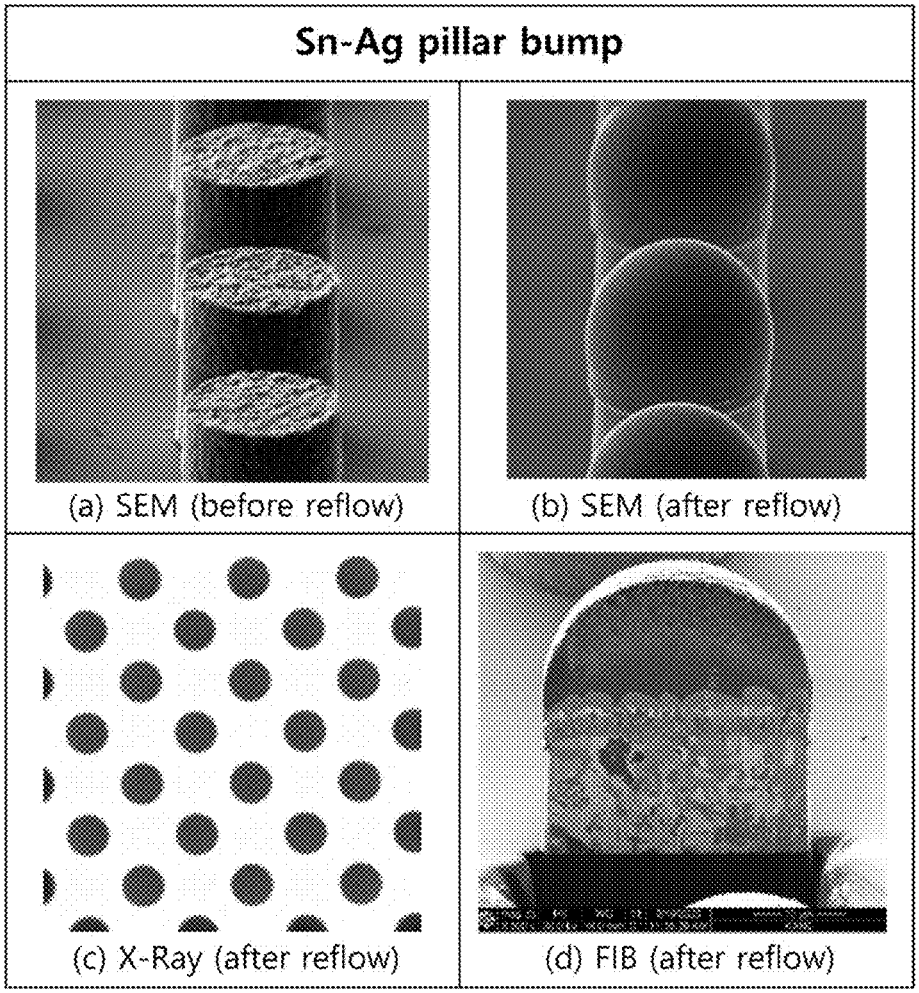
FIG. 1 shows photographs of electroplated bumps by using a tin-silver plating solution of Example 1.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. Like reference numerals refer to like elements throughout.

An electroplating solution of tin or a tin alloy of the present disclosure used to plate wafer bumps includes metal ions, a conductive salt, a structure refiner, and a thickness variation improving agent. If the plating solution of the present disclosure is a tin electroplating solution, the metal ions are tin ions. If the plating solution of the present disclosure is a tin alloy electroplating solution, the metal ions are tin ions and silver ions, and the electroplating solution further includes a silver complexing agent. Moreover, the electroplating solution of tin or a tin alloy of the present disclosure may further include a surfactant and an antioxidant.

Tin sulfate or tin methanesulfonate may be used as a source of tin ions. Since tin sulfate is mainly used for low-speed plating, tin methanesulfonate may be used preferably. The concentration of tin ions in the plating solution may be 40-120 g/L. When the concentration of tin ions is less than 40 g/L, the plating film structure or the bump shape may not be uniform, and when the concentration of tin ions is greater than 120 g/L, the silver content in the plating film may be lowered, resulting in a change in the size of the plating particles.

Silver methanesulfonate may be used as a source of silver ions. The concentration of silver ions in the plating solution is preferably maintained at 0.1-1 g/L. If the concentration of silver ions is less than 0.1 g/L, whisker is likely to be generated. The silver content in the plating film is preferably maintained within 5%, and when the concentration of silver ions is greater than 1 g/L, the silver content in the plating film becomes too high, resulting in an increase in the melting temperature.

Methanesulfonic acid may be used as the conductive salt or electrolyte in the same manner as the metal ions. The concentration of conductive salt may be 100-300 g/L. If the concentration of conductive salt is less than 100 g/L, the uniformity of the bump plating film deteriorates, and if the concentration of conductive salt is greater than 300 g/L, the plating speed decreases.

As the silver complexing agent, pyrophosphate, an iodine compound, and ureas may be used. Preferably, urea, thiourea, dimethylthiourea, allylthiourea, phenylurea and the like may be used. More preferably, phenylurea may be used at 5-30 g/L.

In addition, uniform silver content distribution in the plating film may be obtained when a combination of ureas and a mercaptotetrazole compound is used as the silver complexing agent. Preferably, a combination of phenylurea and a mercaptotetrazole compound may be used as the silver complexing agent. Here, phenylurea may be used at a concentration of 5-30 g/L. If the concentration of phenylurea is less than 5 g/L, silver ions are difficult to stabilize in the plating solution, and if the concentration is greater than 30 g/L, there occurs a phenomenon in which the plating speed slows down or plating of a tin-silver alloy is not generated. The mercaptotetrazole compound may be used at a concentration of 0.5-10 g/L. If the concentration of the mercaptotetrazole compound is less than 0.5 g/L, it does not affect the distribution of silver content in the plating film, and if the concentration is greater than 10 g/L, there occurs a phenomenon in which the variation in silver content in the plating film increases. Examples of the mercaptotetrazole compound include 1-(2-diethylaminoethyl)-5-mercapto-1,2,3,4-tetrazole, 1-(3-ureidophenyl)-5-mercaptotetrazole, 1-((3-N-ethyl oxalamido)phenyl)-5-mercaptotetrazole, 1-(4-acetamidophenyl)-5-mercaptotetrazole, 1-(4-carboxyphenyl)-5-mercaptotetrazole, and the like. Preferably, 1-(2-diethylaminoethyl)-5-mercapto-1,2,3,4-tetrazole may be used as the mercaptotetrazole compound.

Unlike cyanide compounds, the combination of phenylurea and mercaptotetrazole is harmless to the human body and environmentally friendly, and thus working environment may be improved, the stability of silver ions in the electroplating solution may be obtained, a constant silver content in the plating film may be obtained, and moreover, the variation in the silver content distribution within the plating film may be maintained at a low level, so that the silver content across the entire region of the plating film may be uniformly controlled. The weight ratio of the phenylurea and the mercaptotetrazole compound in the plating solution may be 2:1 to 10:1, preferably 2.5:1 to 7.5:1.

As the structure refiner, a carboxylic acid may be used except for ketones or aldehydes. When ketones or aldehydes and a carboxylic acid are mixed and used, the plating properties are deteriorated, and thus it is preferable to use only a carboxylic acid as the structure refiner. As a carboxylic acid, at least one selected from the group consisting of acrylic acid, cinnamic acid, methacrylic acid, and sorbic acid may be used. Preferably, among these, acrylic acid or methacrylic acid, which is readily soluble, may be used. The concentration of carboxylic acid may be 0.1-5 g/L. If the concentration of carboxylic acid is less than 0.1 g/L or greater than 5 g/L, there occurs a phenomenon in which the uniformity of the plating film deteriorates.

Cationic surfactants, anionic surfactants, amphoteric surfactants, and nonionic surfactants may be used as the surfactants. Preferably, in order to obtain bumps in a uniform shape and a uniform plating film, nonionic surfactants may be used in consideration of reactivity and interaction with a carboxylic acid, which is a structure refiner. More preferably, amine-based nonionic surfactants may be used. As the surfactants, copolymers of polyoxyethylene and propylene or polyoxyethylene amines may be used. Preferably, at least one selected from the group consisting of polyoxyethylene laurylamine ether and polyoxyethylene stearylamine ether may be used. The concentration of surfactants may be 0.5-6 g/L.

The antioxidant may serve to prevent tin from being oxidized to a tetravalent oxidation state, and may be at least one selected from the group consisting of catechol, hydroquinone, and resorcinol. Preferably, hydroquinone may be used. The concentration of antioxidant may be 0.1-2 g/L.

The thickness variation improving agent serves to improve the bump thickness variation within a wafer or within a die. A combination of a flavone compound and a quaternary ammonium compound may be used as the thickness variation improving agent. As the flavone compound, a pentahydroxy flavone may be used, and the flavone compound may be used at a concentration of approximately 0.01-0.3 g/L. As the quaternary ammonium compound, benzalkonium chloride may be used, and the quaternary ammonium compound may be used at a concentration of approximately 0.1-5 g/L. In order to improve the bump thickness variation, the weight ratio of the flavone compound and the quaternary ammonium compound is preferably approximately 1:5 to 1:10.

A method for forming the wafer bumps using the electroplating solution of tin or a tin alloy includes a step in which an electroplating solution of tin or tin-silver is prepared, the plating solution is then stirred, the object to be plated is put into the electroplating solution, and a current is applied at a current density of 5-15 A/dm$^2$ to perform plating. Since the electroplating solution of the present disclosure is composed to obtain an excellent plating film even at a high current density, it is preferable that the current density is greater than 5 A/dm$^2$, if the current density is less than 5 A/dm$^2$, the plating particles become larger and thus the shapes of bumps become non-uniform, and if the current density is greater than 15 A/dm$^2$, the plating structure becomes rough and thus the plating efficiency decreases.

The temperature of the plating solution may be 20-35° C., preferably 25-30° C.

The stirring of the plating solution may maintain a certain level, for example, a flow rate of 1-4 L/min, regardless of the method.

Hereinafter, the configuration of the present invention and resultant effects will be described in detail with reference to Examples and Comparative Examples. The present examples are for describing the present invention in more detail, and the scope of the present invention is not limited by the present examples.

Examples

Ingredients and contents of the electroplating solutions of a tin-silver alloy according to examples of the present invention, and plating conditions (current density, temperature, and flow rate) applied during the electroplating are listed in Table 1 below:

TABLE 1

| | Example 1 | Example 2 | Example 3 |
|---|---|---|---|
| Tin ions | 60 g/L | 60 g/L | 60 g/L |
| Conductive salt | Methanesulfonic acid 150 g/L | Methanesulfonic acid 150 g/L | Methanesulfonic acid 150 g/L |
| Antioxidant | Hydroquinone 1 g/L | Hydroquinone 1 g/L | Hydroquinone 1 g/L |
| Surfactant | Polyoxyethylene stearylamine ether 3 g/L | Polyoxyethylene stearylamine ether 3 g/L<br>Polyoxyethylene laurylamine ether 3 g/L | Polyoxyethylene stearylamine ether 3 g/L |
| Silver ions | 0.45 g/L | 0.45 g/L | 0.45 g/L |
| Complexing agent | Phenylurea 10 g/L<br>Diethylaminoethyl mercaptotetrazole 2 g/L | Phenylurea 10 g/L<br>Diethylaminoethyl mercaptotetrazole 2 g/L | Phenylurea 10 g/L<br>Diethylaminoethyl mercaptotetrazole 2 g/L |
| Structure refiner | Acrylic acid 0.2 g/L | Methacrylic acid 2 g/L | Methacrylic acid 1.5 g/L |
| Thickness variation improving agent | Pentahydroxyflavone 0.03 g/L<br>Benzalkonium chloride 0.3 g/L | Pentahydroxyflavone 0.05 g/L<br>Benzalkonium chloride 0.4 g/L | Pentahydroxyflavone 0.1 g/L<br>Benzalkonium chloride 0.5 g/L |
| Current density | 11 A/dm$^2$ | 11 A/dm$^2$ | 11 A/dm$^2$ |
| Temperature | 25° C. | 25° C. | 25° C. |
| Flow rate | 3.5 L/min | 3.5 L/min | 3.5 L/min |

Ingredients and contents of the electroplating solutions of tin according to examples of the present invention, and plating conditions (current density, temperature, and flow rate) applied during the electroplating are listed in Table 2 below:

TABLE 2

| | Example 4 | Example 5 | Example 6 |
|---|---|---|---|
| Tin ions | 60 g/L | 60 g/L | 60 g/L |
| Conductive salt | Methanesulfonic acid 150 g/L | Methanesulfonic acid 150 g/L | Methanesulfonic acid 150 g/L |
| Antioxidant | Hydroquinone 1 g/L | Hydroquinone 1 g/L | Hydroquinone 1 g/L |
| Surfactant | Polyoxyethylene stearylamine ether 3 g/L | Polyoxyethylene laurylamine ether 5 g/L | Polyoxyethylene stearylamine ether 3 g/L Polyoxyethylene laurylamine ether 3 g/L |
| Structure refiner | Acrylic acid 0.2 g/L | Methacrylic acid 2 g/L | Methacrylic acid 2 g/L |
| Thickness variation improving agent | Pentahydroxyflavone 0.05 g/L Benzalkonium chloride 0.3 g/L | Pentahydroxyflavone 0.07 g/L Benzalkonium chloride 0.6 g/L | Pentahydroxyflavone 0.1 g/L Benzalkonium chloride 0.9 g/L |
| Current density | 14 A/dm$^2$ | 12 A/dm$^2$ | 15 A/dm$^2$ |
| Temperature | 25° C. | 25° C. | 25° C. |
| Flow rate | 3.5 L/min | 3.5 L/min | 3.5 L/min |

Figure 2:
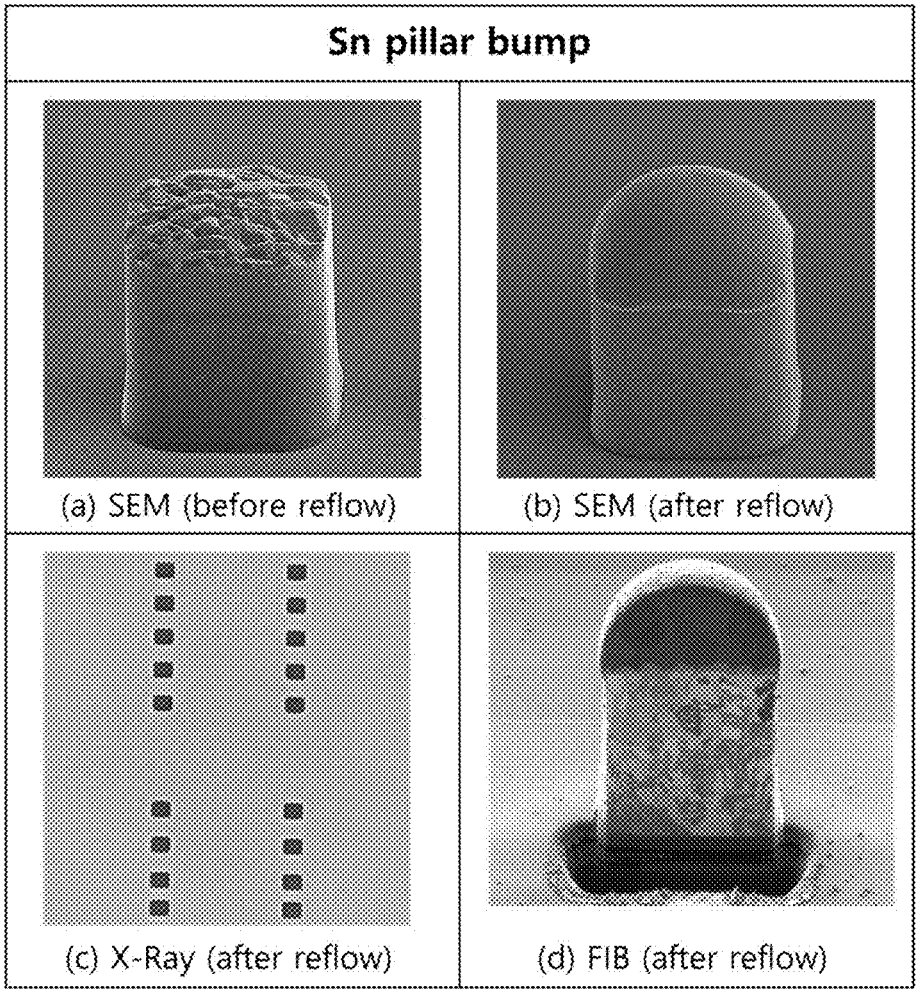
FIG. 2 shows photographs of electroplated bumps by using a tin plating solution of Example 4.

Bumps prepared by performing a typical plating process (degreasing, pickling, plating, neutralizing, and drying) using the tin-silver electroplating solutions according to Examples 1 to 3 and the tin electroplating solutions according to Examples 4 to 6, respectively, were observed. FIG. 1 shows photographs of electroplated bumps by using a tin-silver plating solution of Example 1. FIG. 2 shows photographs of electroplated bumps by using a tin plating solution of Example 4. In FIGS. 1 and 2, (a) is an SEM photograph before the reflow of the electroplated bump, (b) is an SEM photograph after the reflow of the electroplated bump, (c) is a photograph taken with an X-ray after the reflow of the electroplated bump, and (d) is a photograph observed with a focused ion beam (FIB) after the reflow of the electroplated bump. As shown in FIGS. 1 and 2, it was confirmed that the plating film and the bump shape were uniform, and no voids were observed in the bump. Bumps according to Examples 2 to 6 also showed substantially the same results.

The results of reflowing the electroplated bumps using the plating solutions of Examples 1 to 6 of the present invention and then measuring the bump thickness variation within the die are listed in Table 3 below:

TABLE 3

| | Average WID (%) | |
|---|---|---|
| | Wafer pattern 1 | Wafer pattern 2 |
| Example 1 | 3.26 | 3.47 |
| Example 2 | 3.01 | 3.12 |
| Example 3 | 3.45 | 3.22 |
| Example 4 | 3.45 | 3.31 |
| Example 5 | 3.11 | 3.41 |
| Example 6 | 2.92 | 3.08 |

As shown in Table 3, it was confirmed that the average within-die (WID) representing the bump thickness variation in all cases of the tin-silver plating solutions (Examples 1 to 3) and the tin plating solutions (Examples 4 to 6) was maintained at a level within 5%, or within 4%, preferably 2.9%-3.5%.

Comparative Example

Ingredients and contents of the electroplating solutions of a tin-silver alloy used as Comparative Examples, and plating conditions (current density, temperature, and flow rate) applied during the electroplating are listed in Table 4 below:

TABLE 4

| | Comparative Example 1 | Comparative Example 2 | Comparative Example 3 |
|---|---|---|---|
| Tin ions | 60 g/L | 60 g/L | 60 g/L |
| Conductive salt | Methanesulfonic acid 150 g/L | Methanesulfonic acid 150 g/L | Methanesulfonic acid 150 g/L |
| Antioxidant | Hydroquinone 1 g/L | Hydroquinone 1 g/L | Hydroquinone 1 g/L |
| Surfactant | Polyoxyethylene stearylamine ether 3 g/L | Polyoxyethylene stearylamine ether 3 g/L Polyoxyethylene laurylamine ether 3 g/L | Polyoxyethylene stearylamine ether 3 g/L |

TABLE 4-continued

| | Comparative Example 1 | Comparative Example 2 | Comparative Example 3 |
|---|---|---|---|
| Silver ions | 0.45 g/L | 0.45 g/L | 0.45 g/L |
| Complexing agent | Phenylurea 10 g/L Diethylaminoethyl mercaptotetrazole 2 g/L | Phenylurea 10 g/L Diethylaminoethyl mercaptotetrazole 2 g/L | Phenylurea 10 g/L Diethylaminoethyl mercaptotetrazole 2 g/L |
| Structure refiner | Acrylic acid 0.2 g/L | Methacrylic acid 2 g/L | Methacrylic acid 1.5 g/L |
| Thickness variation improving agent | | Pentahydroxyflavone 0.05 g/L | Benzalkonium chloride 0.5 g/L |
| Current density | 11 A/dm$^2$ | 11 A/dm$^2$ | 11 A/dm$^2$ |
| Temperature | 25° C. | 25° C. | 25° C. |
| Flow rate | 3.5 L/min | 3.5 L/min | 3.5 L/min |

Ingredients and contents of the electroplating solutions of tin used as Comparative Examples, and plating conditions (current density, temperature, and flow rate) applied during the electroplating are listed in Table 5 below:

TABLE 5

| | Comparative Example 4 | Comparative Example 5 | Comparative Example 6 |
|---|---|---|---|
| Tin ions | 60 g/L | 60 g/L | 60 g/L |
| Conductive salt | Methanesulfonic acid 150 g/L | Methanesulfonic acid 150 g/L | Methanesulfonic acid 150 g/L |
| Antioxidant | Hydroquinone 1 g/L | Hydroquinone 1 g/L | Hydroquinone 1 g/L |
| Surfactant | Polyoxyethylene stearylamine ether 3 g/L | Polyoxyethylene laurylamine ether 5 g/L | Polyoxyethylene stearylamine ether 3 g/L Polyoxyethylene laurylamine ether 3 g/L |
| Structure refiner | Acrylic acid 0.2 g/L | Methacrylic acid 2 g/L | Methacrylic acid 2 g/L |
| Thickness variation improving agent | | Pentahydroxyflavone 0.07 g/L | Benzalkonium chloride 0.9 g/L |
| Current density | 14 A/dm$^2$ | 12 A/dm$^2$ | 15 A/dm$^2$ |
| Temperature | 25° C. | 25° C. | 25° C. |
| Flow rate | 3.5 L/min | 3.5 L/min | 3.5 L/min |

In Comparative Examples 1 and 4, the thickness variation improving agent was not used. In Comparative Examples 2 and 5, only pentahydroxyflavone was used alone as the thickness variation improving agent. In Comparative Examples 3 and 6, only benzalkonium chloride was used alone as the thickness variation improving agent. Bumps prepared by performing a typical plating process (degreasing, pickling, plating, neutralizing, and drying) using the tin-silver electroplating solutions according to Comparative Examples 1 to 3 and the tin electroplating solutions according to Comparative Examples 4 to 6, respectively, were observed. The results of reflowing the electroplated bumps using the plating solutions of Comparative Examples 1 to 6 and then measuring the bump thickness variation within the die are listed in Table 6 below:

TABLE 6

| | Average WID (%) | |
|---|---|---|
| | Wafer pattern 1 | Wafer pattern 2 |
| Comparative Example 1 | 6.28 | 5.49 |
| Comparative Example 2 | 4.95 | 5.01 |
| Comparative Example 3 | 5.98 | 5.53 |
| Comparative Example 4 | 5.38 | 5.54 |
| Comparative Example 5 | 4.68 | 4.82 |
| Comparative Example 6 | 5.11 | 4.92 |

When both the flavone compound and the quaternary ammonium compound were not added (Comparative Examples 1 and 4), the average WID representing the thickness variation was the largest. When the quaternary ammonium compound was added alone (Comparative Examples 3 and 6), there was little effect on improving the thickness variation. When the flavone compound was added alone (Comparative Examples 2 and 5), the thickness variation was slightly reduced, but the average WID was found to be 4.68%.

Comparing Table 3 and Table 6, when the combination of the flavone compound and the quaternary ammonium compound is used as the thickness variation improving agent, the thickness variation or the average WID is reduced by about 25-30% compared to the case otherwise (that is, when neither is used or only one is used).

As described above, the electroplating solution of tin or a tin alloy for plating wafer bumps according to the present invention has the following excellent effects.

First, by using, as a silver complexing agent, a combination of phenylurea and mercaptotetrazole compounds instead of a conventional cyanide compound, an electroplating solution of a tin-silver alloy is harmless to the human body and environmentally friendly, and thus working environment may be improved, stability of silver ions within the electroplating solution may be obtained, and the variation in the silver content within the plating film may be maintained at a low level even when plating conditions, such as wafer size, current density, temperature, and flow rate, are changed, thereby ensuring mass productivity and reliability.

Second, in the case of the electroplating solution of tin or a tin-silver alloy, a small amount of carboxylic acid is used as a structure refiner except for ketones and aldehydes, and thus bumps in a uniform shape, and a uniform plating film may be obtained by the interaction of the carboxylic acid and a nonionic surfactant which is polyoxyethylene laurylamine ether or polyoxyethylene stearylamine ether. It is preferable that only the carboxylic acid alone is used as the structure refiner of the present disclosure. When the carboxylic acid is used in combination with conventional ketones or aldehydes, it has been confirmed that the plating properties are significantly deteriorated. In addition, unlike ketones or aldehydes, when the carboxylic acid is used as a structure refiner, the difference in ratio consumed from other components is small, and thus uniform electroplating may be carried out and productivity may be improved by more easily managing the concentration of the plating solution.

Third, in the case of an electroplating solution of tin or a tin-silver alloy, a combination of a flavone compound and a quaternary ammonium compound is used as a thickness variation improving agent, and thus burnt deposits do not occur even at a high plating speed (or current density) and the thickness variation of bumps is maintained at a low level, thereby ensuring mass productivity and reliability. In contrast to the case of using a flavone compound alone or a quaternary ammonium compound alone, it has been confirmed that the bump thickness variation or the average within-die (WID) is reduced by about 25-30% when a combination of a flavone compound and a quaternary ammonium compound is used as in the present disclosure.

According to the electroplating solution of tin or a tin alloy of the present disclosure combined in such a special configuration, a high-quality plating film and bumps may be obtained at a high current density, for example, 5-20 A/dm$^2$, and preferably 8-15 A/dm$^2$.

Although the examples of the present invention have been described with reference to the accompanying drawings, those with ordinary skill in the art to which the present invention pertains will understand that the present invention can be carried out in other specific forms without changing the technical spirit or essential features. Therefore, the above-described examples are to be understood in all aspects as illustrative and not restrictive.

What is claimed is:

1. An electroplating solution of tin or a tin alloy for wafer bumps comprising:

tin ions as metal ions; silver ions as metal ions; a conductive salt; a carboxylic acid as a structure refiner;

a combination of a flavone compound and a quaternary ammonium compound as a thickness variation improving agent; and a combination of phenylurea and a mercaptotetrazole compound as a silver complexing agent.

2. The electroplating solution of tin or a tin alloy of claim 1, wherein a weight ratio of the flavone compound and the quaternary ammonium compound constituting the thickness variation improving agent is in a range between 1:5 and 1:10.

3. The electroplating solution of tin or a tin alloy of claim 1, wherein the electroplating solution comprises 0.01-0.3 g/L of pentahydroxyflavone and 0.1-5 g/L of benzalkonium chloride as the thickness variation improving agent.

4. The electroplating solution of tin or a tin alloy of claim 1, wherein a weight ratio of the phenylurea and the mercaptotetrazole compound is in a range between 2:1 and 10:1.

5. An electroplating solution of tin or a tin alloy for wafer bumps comprising:

tin ions as metal ions; a conductive salt; a carboxylic acid as a structure refiner; and a combination of a flavone compound and a quaternary ammonium compound as a thickness variation improving agent;

wherein the electroplating solution comprises 0.01-0.3 g/L of pentahydroxyflavone and 0.1-5 g/L of benzalkonium chloride as the thickness variation improving agent.

* * * * *